US008079892B2

(12) United States Patent
Wang et al.

(10) Patent No.: US 8,079,892 B2
(45) Date of Patent: Dec. 20, 2011

(54) TOY AUTOMOBILE

(75) Inventors: Kui-Jun Wang, Shenzhen (CN); Feng-Xiang Tang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 218 days.

(21) Appl. No.: 12/693,414

(22) Filed: Jan. 25, 2010

(65) Prior Publication Data

US 2011/0028068 A1 Feb. 3, 2011

(30) Foreign Application Priority Data

Jul. 29, 2009 (CN) ..... 2009 1 0304962

(51) Int. Cl.
*A63H 17/26* (2006.01)

(52) U.S. Cl. ..... 446/466; 446/469; 280/6.154

(58) Field of Classification Search ..... 446/466, 446/469, 470, 465; 280/6.153–6.156, 124.127, 280/5.514, 124.145, 124.134–124.137
See application file for complete search history.

(56) References Cited

U.S. PATENT DOCUMENTS

| | | | | |
|---|---|---|---|---|
| 5,306,038 | A * | 4/1994 | Henderson, Jr. | 446/466 |
| 5,312,288 | A * | 5/1994 | Williams | 446/468 |
| 5,334,077 | A * | 8/1994 | Bailey | 446/466 |
| 5,449,311 | A * | 9/1995 | Williams | 446/468 |
| 5,482,494 | A * | 1/1996 | Ishimoto | 446/456 |
| 5,527,059 | A * | 6/1996 | Lee, Jr. | 446/466 |
| 5,700,026 | A * | 12/1997 | Zalewski et al. | 280/6.152 |
| 5,785,576 | A * | 7/1998 | Belton | 446/456 |
| 6,106,362 | A * | 8/2000 | Keller et al. | 446/456 |
| 6,173,978 | B1 * | 1/2001 | Wagner | 280/124.128 |
| 6,383,054 | B1 * | 5/2002 | Rauch | 446/456 |
| 6,620,023 | B2 * | 9/2003 | Yeung | 446/466 |
| 6,764,376 | B2 * | 7/2004 | Agostini et al. | 446/466 |
| 6,793,555 | B1 * | 9/2004 | Tilbor et al. | 446/456 |
| 7,237,779 | B2 * | 7/2007 | Kondo et al. | 280/6.157 |
| 7,494,141 | B2 * | 2/2009 | Bouton | 280/124.103 |
| 2002/0077026 | A1 * | 6/2002 | Li | 446/466 |
| 2004/0066010 | A1 * | 4/2004 | Laursen | 280/6.154 |
| 2004/0094913 | A1 * | 5/2004 | Flynn et al. | 280/6.153 |
| 2004/0108663 | A1 * | 6/2004 | Rickers | 280/6.154 |
| 2005/0206101 | A1 * | 9/2005 | Bouton | 280/6.154 |
| 2008/0268744 | A1 * | 10/2008 | Jones | 446/462 |

FOREIGN PATENT DOCUMENTS

JP 2002066158 A * 3/2002

* cited by examiner

*Primary Examiner* — Gene Kim
*Assistant Examiner* — Matthew B Stanczak
(74) *Attorney, Agent, or Firm* — Altis Law Group, Inc.

(57) ABSTRACT

A toy automobile includes wheels, axles connecting the wheels, a holding plate, a control circuit, a sensor, and struts and drive trains corresponding to the wheels. Each strut includes a pivoting strut and a support strut pivoted to each other, one ends of the pivoting strut and the support strut are slidably mounted on the axles. The other end of the support strut slidably resist at the bottom surface of the holding plate. Each drive train is connected with another end of the pivoting strut. When the holding plate is tilted relative to a horizontal reference plane, the control circuit controls the drive trains to drive the pivoting struts at a lower end of the holding plate, the pivoting struts rotate and lift the support struts correspondingly, thus to lift the lower end and make the holding plate parallel to the horizontal reference plane.

9 Claims, 10 Drawing Sheets

TOY AUTOMOBILE

BACKGROUND

1. Technical Field

The present disclosure relates to a toy automobile.

2. Description of Related Art

Toy automobiles easily overturn when moving too fast on an incline or curve.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
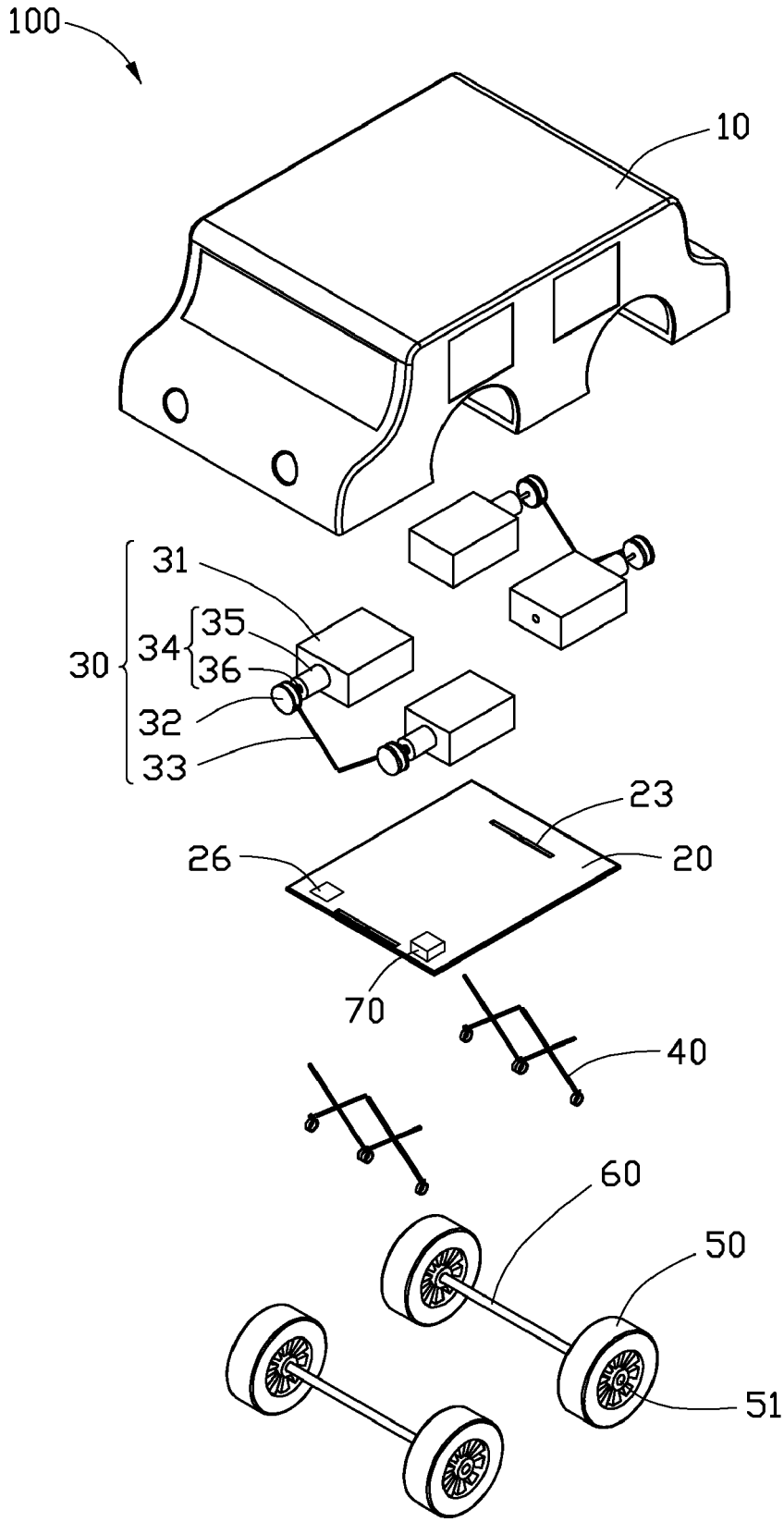
FIG. 1 is an exploded view of a toy automobile according to an exemplary embodiment.

Referring to FIG. 1, a toy automobile 100 includes a body 10, a holding plate 20, four drive trains 30, four struts 40, four wheels 50, two axles 60 and a sensor 70.

Figure 2:
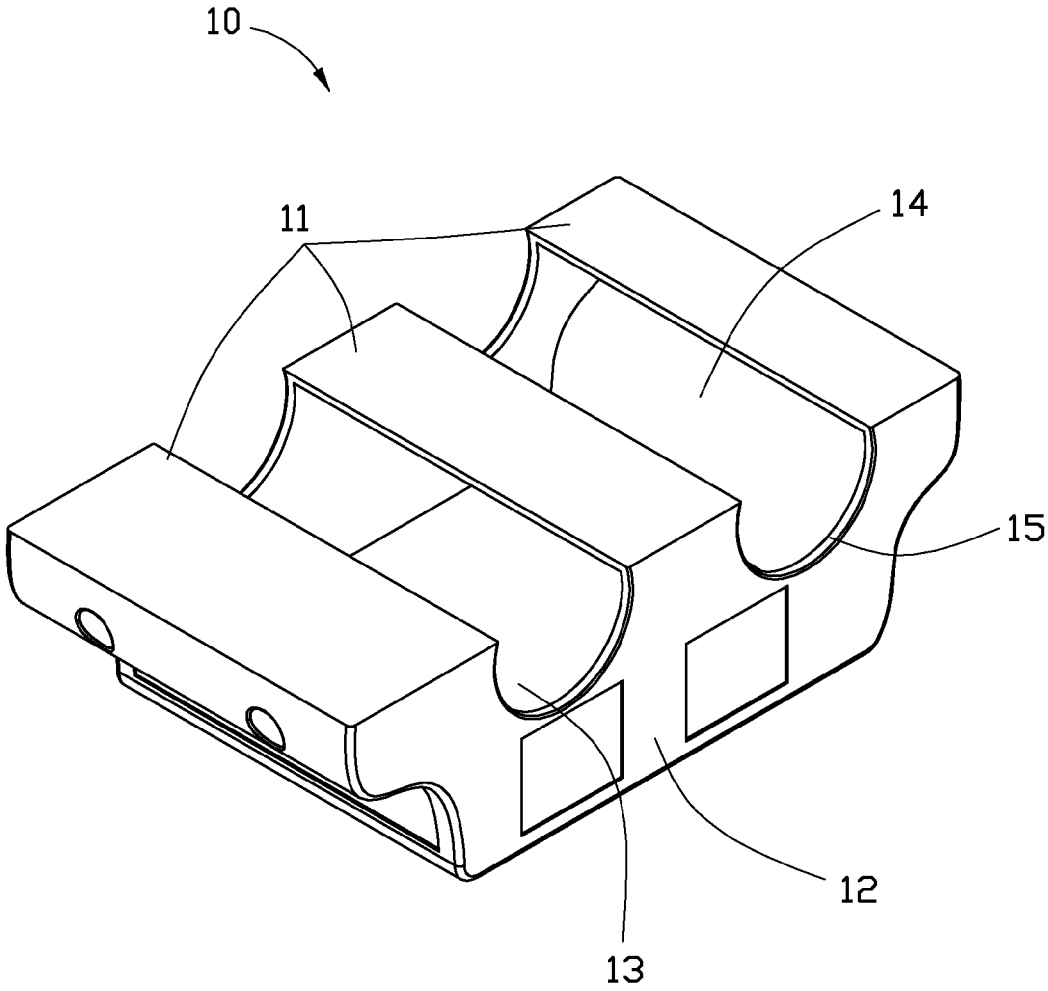
FIG. 2 is a schematic, isometric view of a body of the toy automobile of FIG. 1.

Referring to FIG. 2, the body 10 includes a top plate 13, two sidewalls 12 extended from two opposite sides of the top plate 13, and three spaced base plates 11 connecting the two sidewalls 12 at ends opposite to the top plate 13. The top plate 13, the sidewalls 12, and the base plates 11 form a receiving space 14. Each sidewall 12 defines two wheel wells 15 at an edge near the base plates 11. In this embodiment, the sidewalls 12 and the top plate 13 are integrally formed. The three base plates 11 are mounted on the sidewalls 12 by means of adhering or screwing for example.

Figure 3:
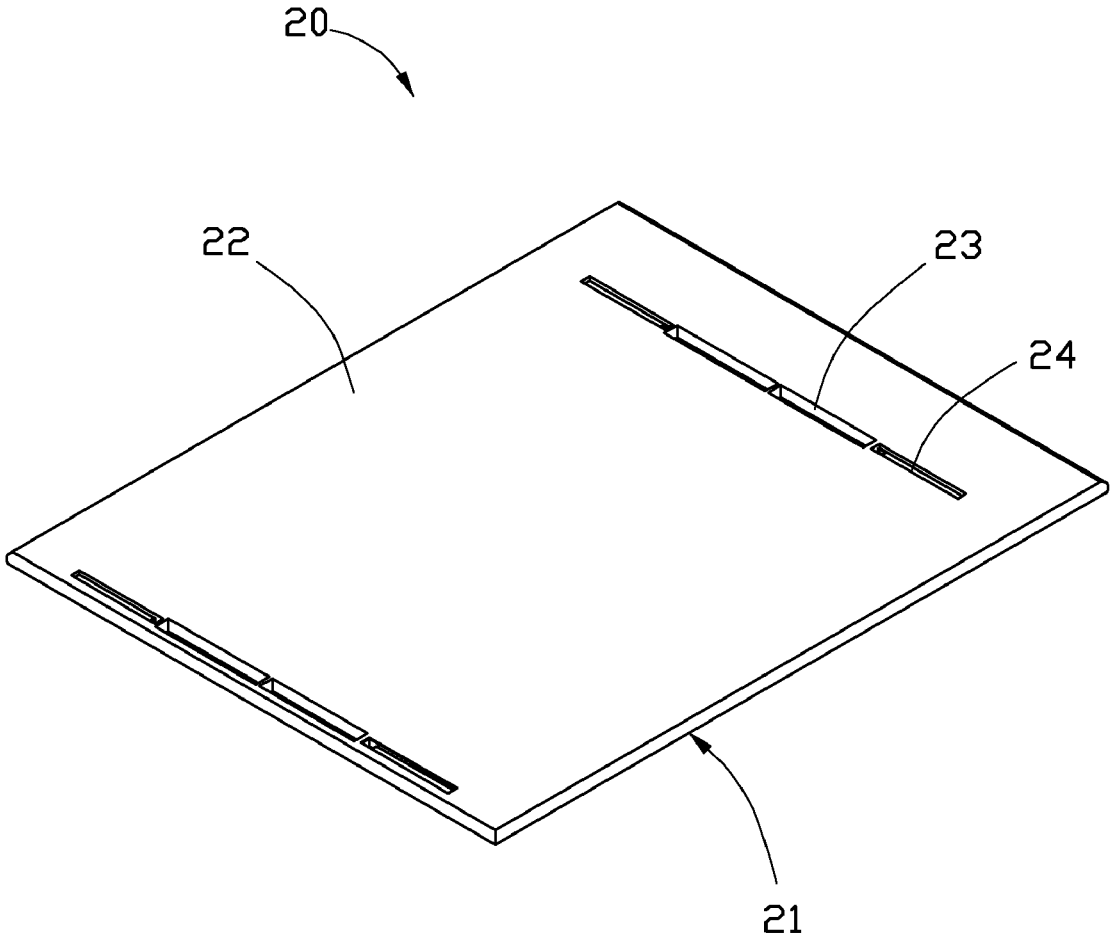
FIG. 3 is a schematic, isometric view of a holding plate of the toy automobile of FIG. 1.
Figure 4:
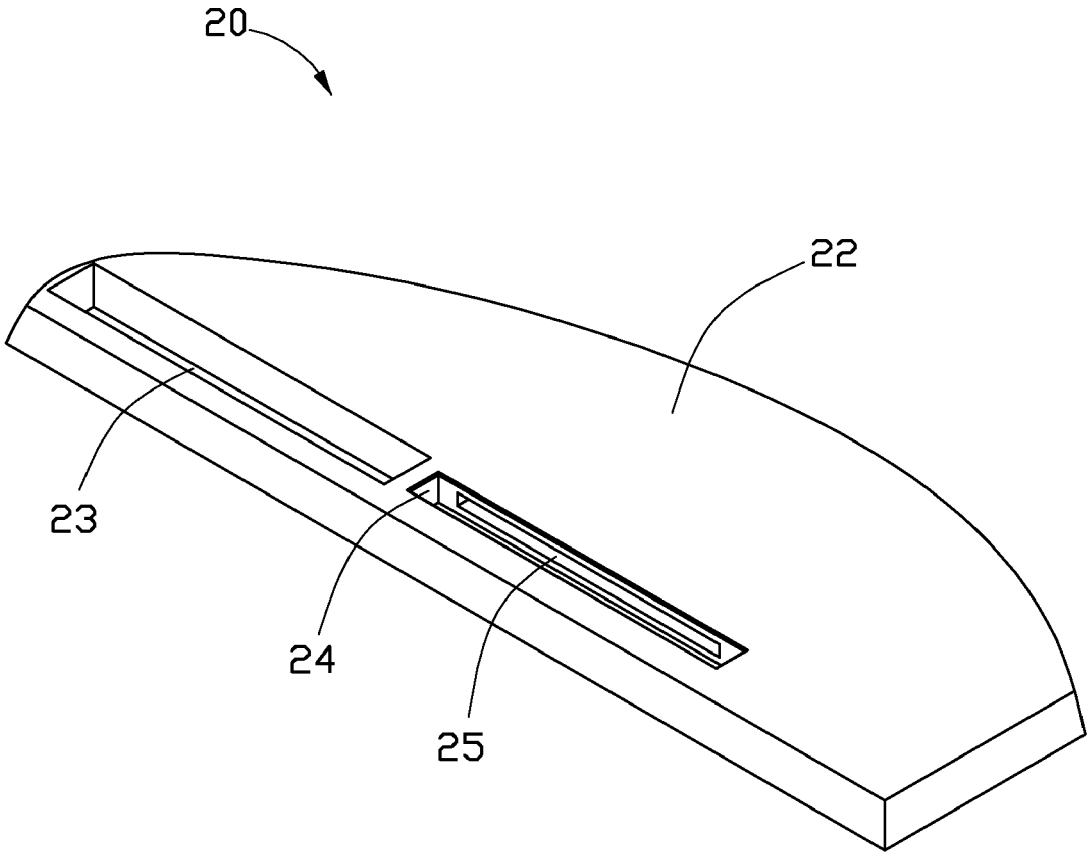
FIG. 4 is an enlarged view of a part of the holding plate of FIG. 3.

Referring to FIGS. 1, 3, and 4, the holding plate 20 is a rectangular plate. The holding plate 20 includes an upper surface 21 and a bottom surface 22. The holding plate 20 defines two rectangular limiting grooves 23 on each of the opposite ends. The limiting grooves 23 extend through the holding plate 20. Two rectangular sliding grooves 24 extend from the bottom surface 22 to the upper surface 21 but do not extend through the holding plate 20 on each the opposite ends. The each pair of the sliding grooves 24 and the corresponding two limiting grooves 23 are collinear, and the two corresponding limiting grooves 23 are located between the two sliding grooves 24. Two rectangular-locking grooves 25 are defined in two sidewalls of each sliding groove 24, respectively. A control circuit 26 is set on the holding plate 20.

Referring to FIG. 1, each drive train 30 includes a fixed block 31, a drive wheel 32, a connecting band 33, and a motor 34. The fixed block 31 is mounted on the holding plate 20. The fixed block 31 is higher than the drive wheel 32 in a direction perpendicular to the holding plate 20. The motor 34 includes a stator 35 and a rotor 36. The stator 35 is fixed on the fixed block 31. The rotor 36 connects to the drive wheel 32 and drives the wheel 32 to rotate. The connecting band 33 is made of flexible material.

Figure 5:
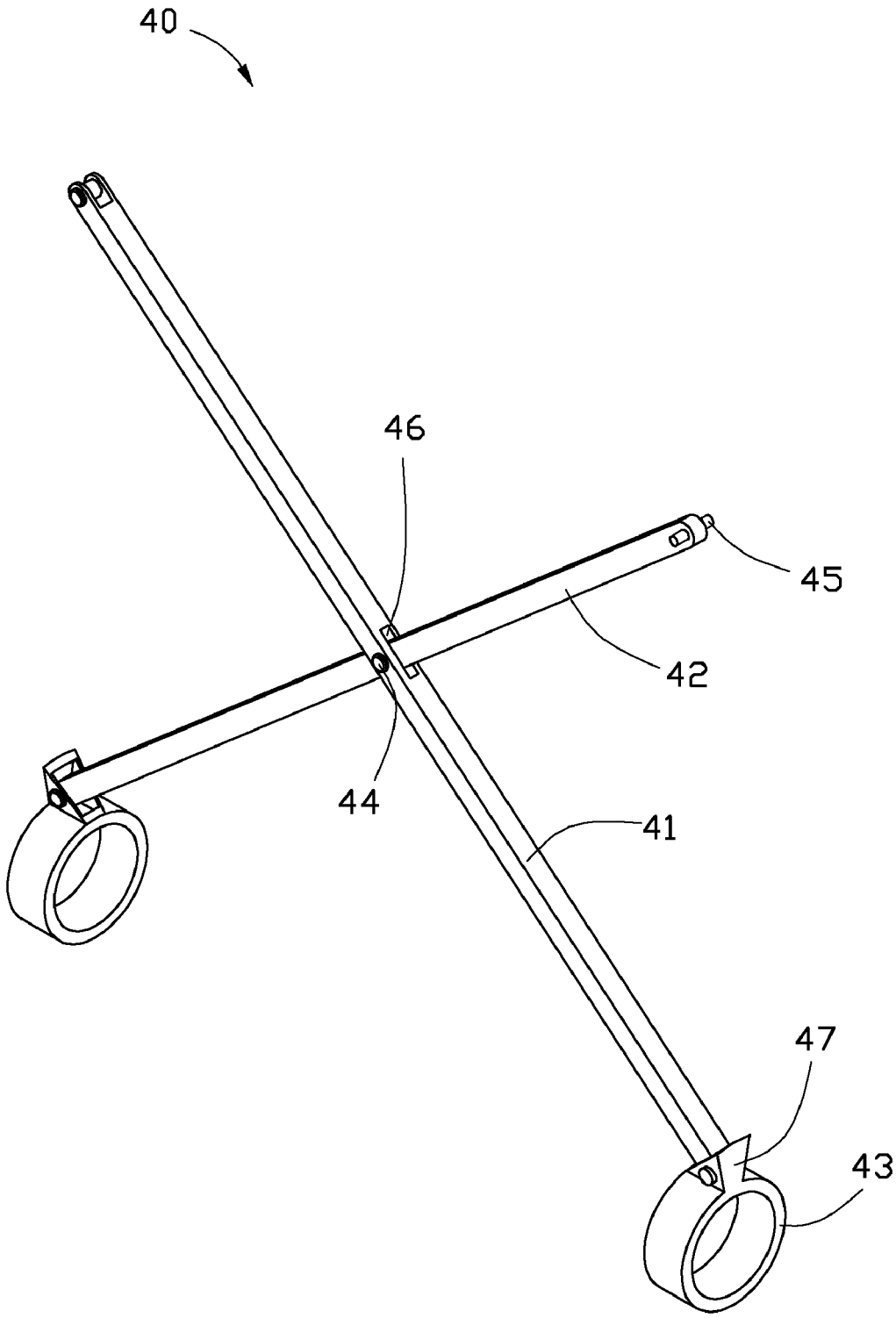
FIG. 5 is a schematic, isometric view of a strut of the toy automobile of FIG. 1.

Referring to FIG. 5, each strut 40 includes a pivoting strut 41, a support strut 42, two sleeves 43, a rotating pin 44 and a sliding pin 45. The pivoting strut 41 defines a through hole 46 in a middle portion thereof. The support strut 42 extends through the hole 46. The pivot pin 44 extends through holes (not shown) defined in the pivoting strut 41 and the support strut 42, thus to rotatably connect the movable strut 41 and the support strut 42. Each sleeve 43 is ring shaped and includes a pivoting clamp 47. One of the pivoting clamps 47 is pivotably attached to an end of the pivoting strut 41. The other pivoting clamp 47 is pivotably attached to a proximal end of the support strut 42. The sliding pin 45 is fixed in a hole (not marked) defined in a distal end of the support strut 42.

The sensor 70 is a tilt sensor for detecting an inclination of the toy automobile 100 relative to a horizontal reference plane. The sensor 70 generates a signal corresponding to the angle of incline.

Figure 6:
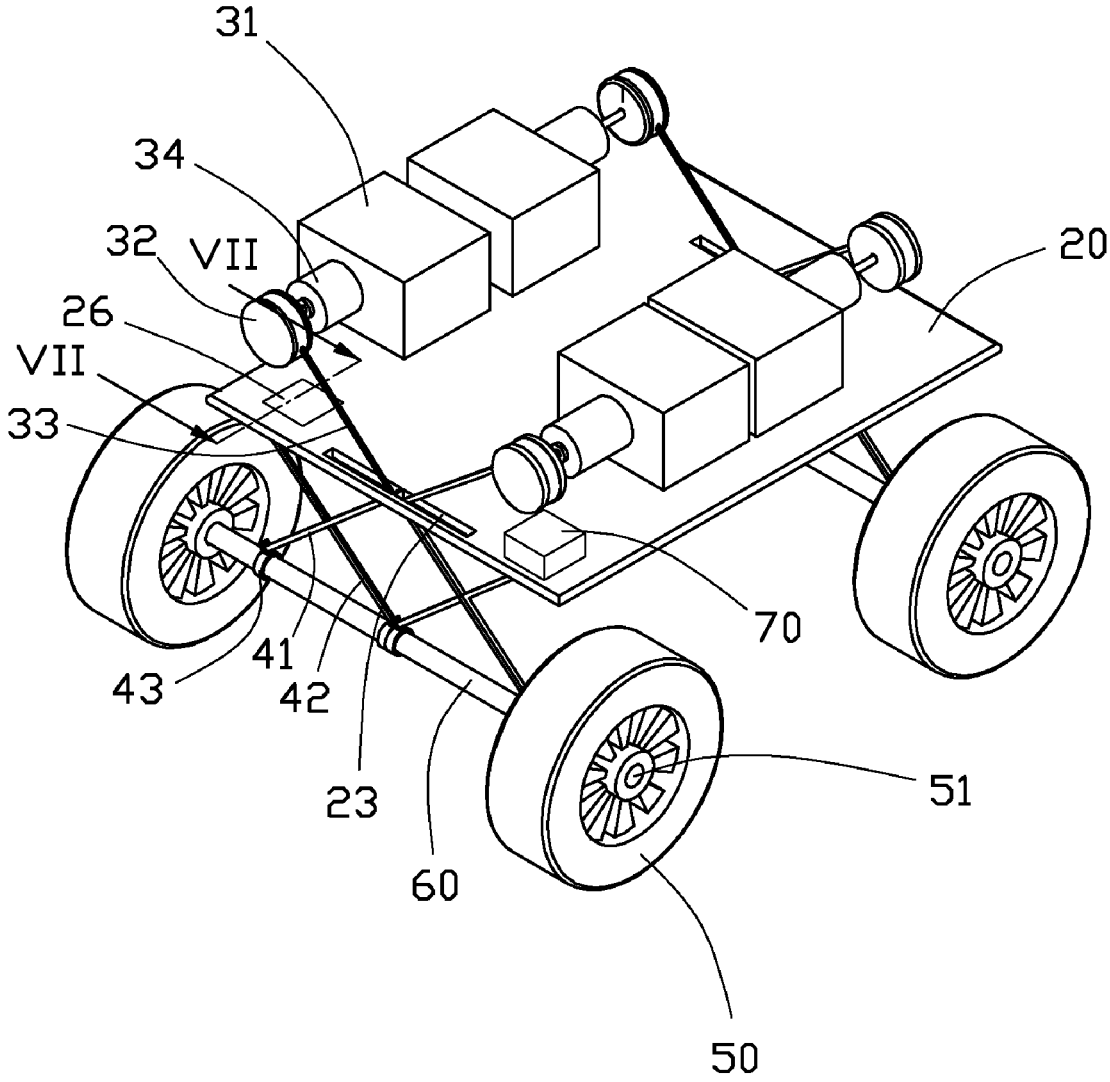
FIG. 6 is a schematic, isometric view of the toy automobile of FIG. 1 with the body removed.
Figure 8:
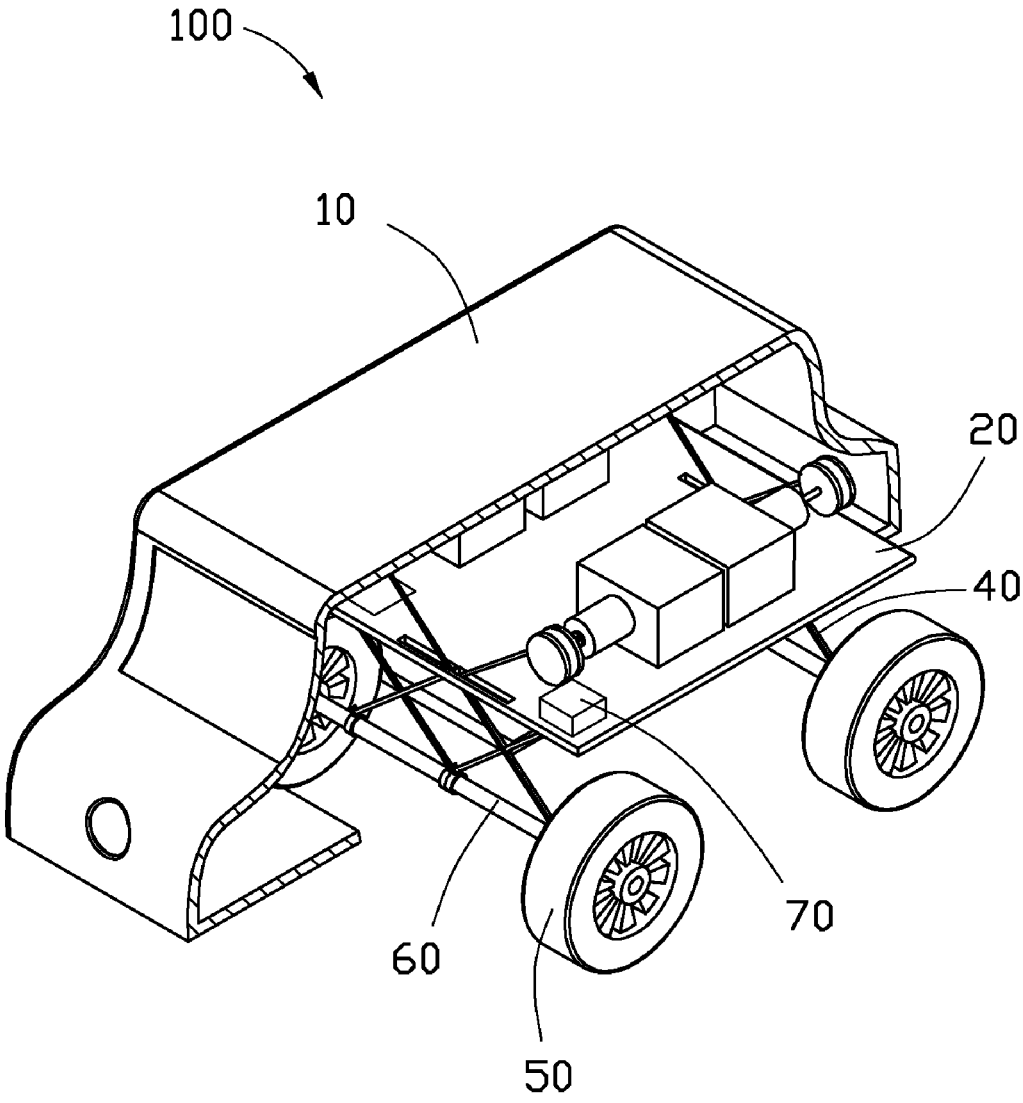
FIG. 8 is a schematic, isometric view of the toy automobile of FIG. 1 with half of the body cutaway.

Referring to FIGS. 1, 6, and 8, in assembling the toy automobile 100, firstly, the sensor 70 must be mounted on the holding plate 20 and electrically connected to the control circuit 26. Secondly, the fixed blocks 31 are mounted on the upper surface 21 of the holding plate 20, and electrically connected to the motors 34 to the control circuit 26. Thirdly, the sleeves 43 are fitted over one of the axles 60 and extend through holes 51 defined in the two wheels, connecting the wheels 50. The end of each connecting band 30 connect to a drive wheel 32, letting the other end of the connecting band 30 extend through the limiting groove 23, and connecting to a free end of the drive strut 41. This lets both ends of the sliding pin 45 plug into the locking grooves 25, allowing the support strut 42 to slide in the defined sliding groove 24. The support strut 42 is supported in the holding plate 20. At last, the body 10 is mounted over the holding plate 20 allowing the receiving space 14 to receive the holding plate 20, the drive trains 30 and the struts 40, and let the wheel wells 15 to receive the wheels 50.

Figure 7:
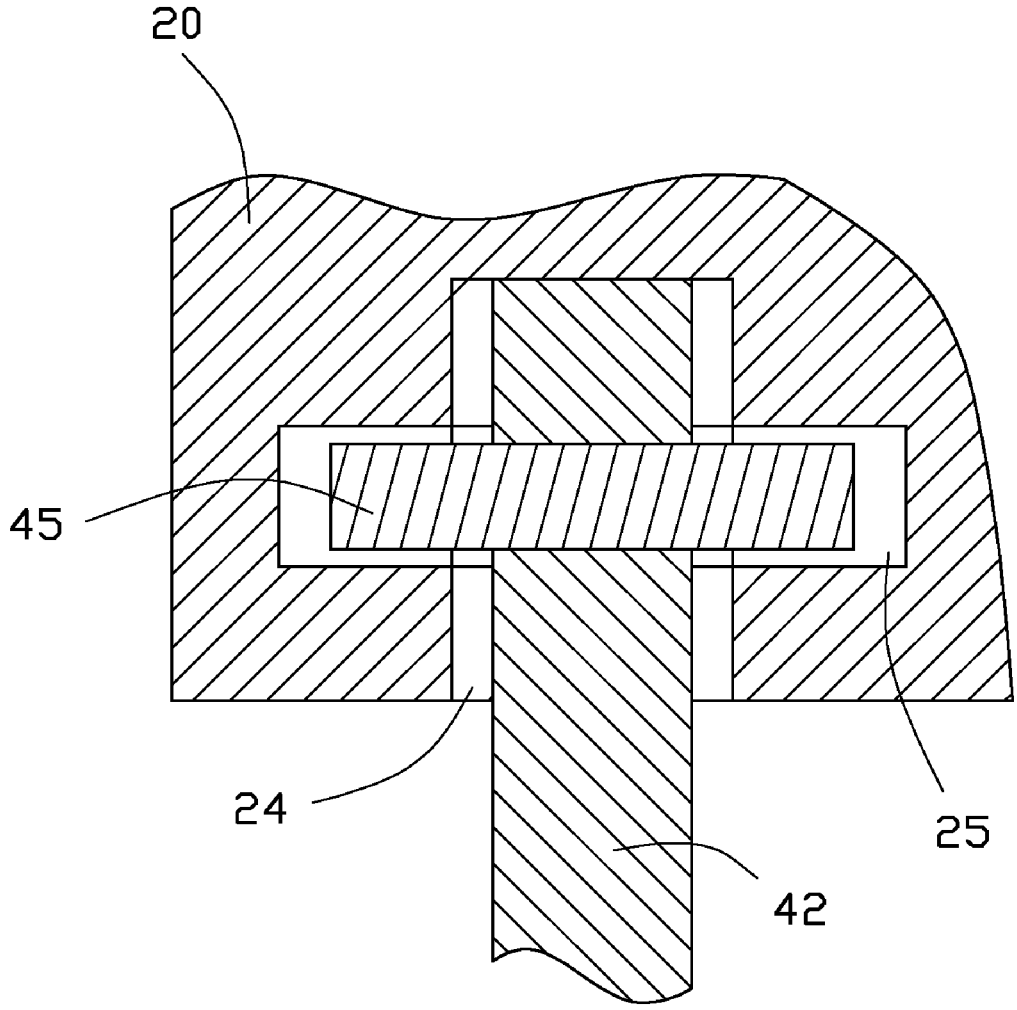
FIG. 7 is a partial, enlarged cross-section view along line VII-VII of FIG. 6.
Figure 9:
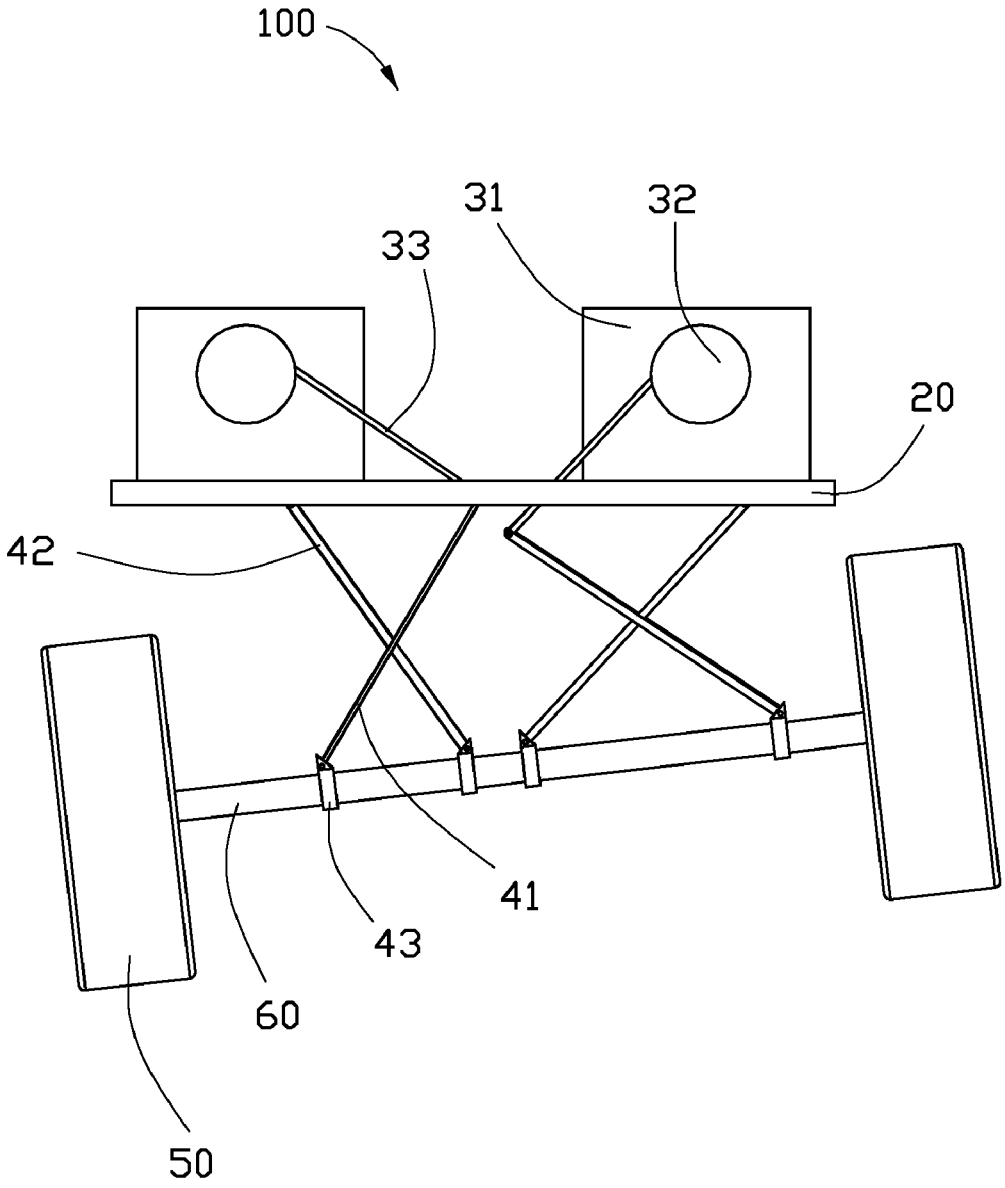
FIG. 9 is a schematic, end view showing the toy automobile being placed on an inclined surface.
Figure 10:
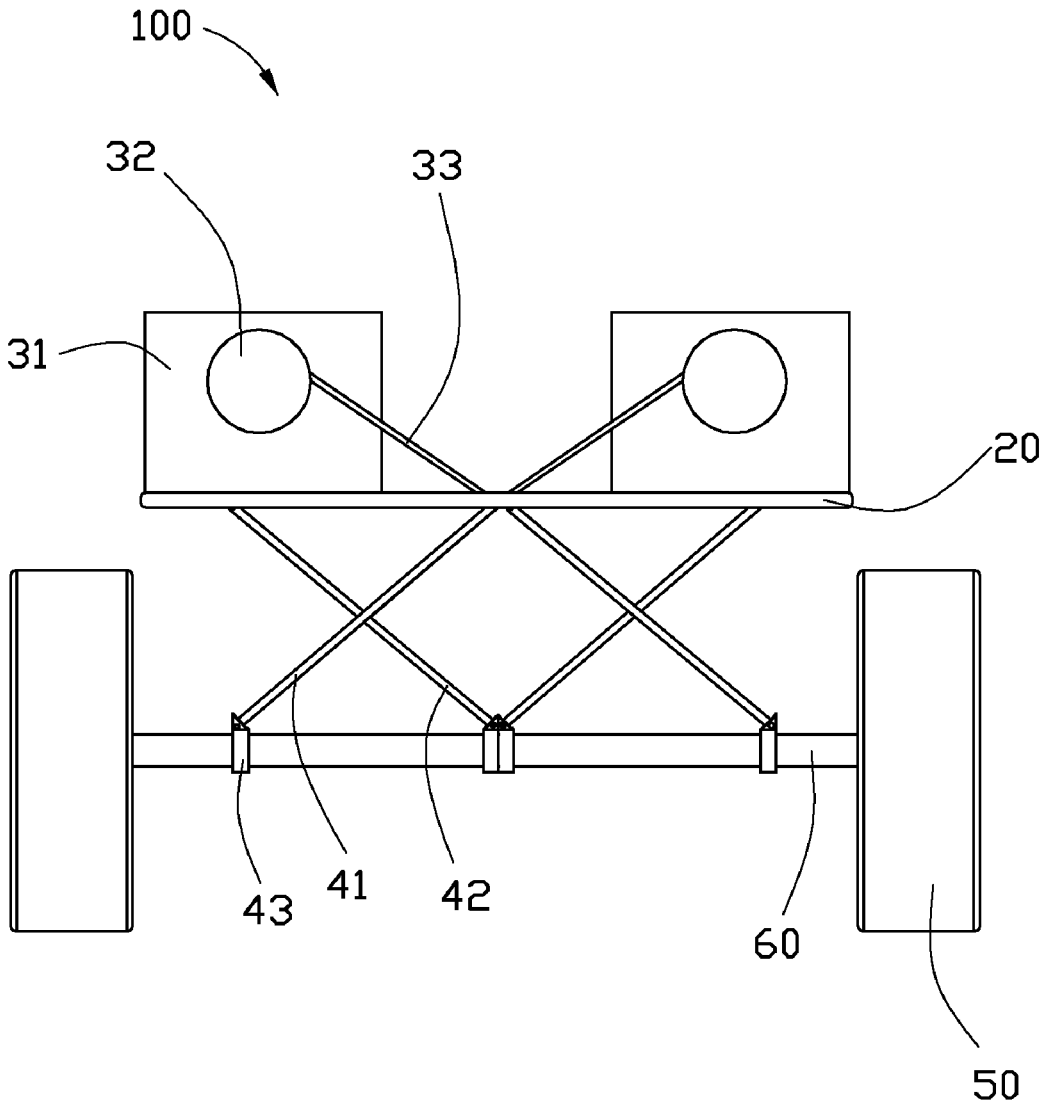
FIG. 10 is a schematic, end view showing the toy automobile being placed on a horizontal surface.

Referring to FIGS. 6, 7, and 9, the toy automobile 100 is put on a platform (not shown), when the sensor 70 detects that the holding plate 20 is tilted relative to a horizontal reference plane, the sensor 70 sends out a signal to the control circuit 26, the control circuit 26 successively drives the two motors 34 located on the lower end of the holding plate 20, the drive wheels 32, and the connecting bands 33 correspondingly. The connecting bands 33 drive the pivoting struts 41 to move, the sleeves 43 mounted on the pivoting struts 41 move to a centre portion of the axles 60, thus lifting the support struts 42. The pivoting struts 41 lift the support struts 42, to lift the lower end of the holding plate 20 correspondingly. In this way, the holding plate 20 stays horizontal, and the toy automobile 100 avoids overturning.

Moreover, it is to be understood that the disclosure may be embodied in other forms without departing from the spirit thereof. Thus, the present examples and embodiments are to be considered in all respects as illustrative and not restrictive, and the disclosure is not to be limited to the details given herein.

What is claimed is:

1. A toy automobile comprising:

four wheels;

two axles each connecting two of the four wheels;

a holding plate comprising an upper surface and a bottom surface;

four struts corresponding to the four wheels respectively, each strut comprising a pivoting strut and a support strut, wherein the pivoting strut and the support strut are rotatably connected to each other, one ends of the pivoting strut and the support strut are slidaby mounted on one of the axles, and the other end of the support strut slidably resist at the bottom surface of the holding plate;

a control circuit;

a sensor electrically connecting with the control circuit, for detecting an inclination of the holding plate relative to a horizontal reference plane and sending the detecting result to the control circuit; and four drive trains electrically connecting with the control circuit, each drive train being connected with another end of the pivoting strut; wherein when the holding plate is tilted relative to the horizontal reference plane, the control circuit controls the drive trains to drive the pivoting struts at a lower end of the holding plate, the pivoting struts rotate and lift the support struts correspondingly, thus to lift the lower end of the holding plate and make the holding plate parallel to the horizontal reference plane.

2. The toy automobile of claim 1, wherein each of the struts further comprise a rotating pin for rotatably connecting the pivoting strut with the support strut.

3. The toy automobile of claim 1, wherein each of the struts comprise two sleeves fit over the axle, the two sleeves are pivotably attached to the pivoting strut and the support strut respectively, thus to slidably mount the pivoting strut and the support strut on the axle.

4. The toy automobile of claim 1, wherein the holding plate defines four sliding grooves for slidably receiving the other ends of the four support struts respectively.

5. The toy automobile of claim 4, wherein the holding plate further comprises locking grooves defined on two faced sidewalls of each of the sliding groove, each strut comprises a sliding pin fixed at the other end of the support strut, two ends of the sliding pin slidably plug into the locking grooves.

6. The toy automobile of claim 1, wherein each drive train comprises a fixed block mounted on the holding plate, a motor fixed on the fixed block, a drive wheel connected with and driven by the motor, and a connecting band connecting the drive wheel with the pivoting strut.

7. The toy automobile of claim 6, wherein the holding plate further defines limiting grooves, the connecting bands extend through the limiting grooves to connect the pivoting struts.

8. The toy automobile of claim 1, further comprising a body for receiving the holding plate, the struts, the drive trains, the sensor and the control circuit.

9. The toy automobile of claim 1, wherein the control circuit and the sensor are mounted on the holding plate.

* * * * *